US006866622B2

(12) United States Patent
Aizawa

(10) Patent No.: US 6,866,622 B2
(45) Date of Patent: Mar. 15, 2005

(54) CENTRIFUGAL ROTOR HAVING BUCKETS SWINGABLY SUPPORTED ON A HINGE SHAFT

(75) Inventor: Masaharu Aizawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 48 days.

(21) Appl. No.: 10/105,624

(22) Filed: Mar. 26, 2002

(65) Prior Publication Data

US 2003/0186798 A1 Oct. 2, 2003

(51) Int. Cl.[7] ..... B04B 5/02
(52) U.S. Cl. ..... 494/20
(58) Field of Search ..... 494/16, 20, 21, 494/33

(56) References Cited

U.S. PATENT DOCUMENTS

| | | | | | |
|---|---|---|---|---|---|
| 3,786,986 | A | * | 1/1974 | Guerrero | 494/20 |
| 4,010,892 | A | * | 3/1977 | Revillet et al. | 494/20 |
| 4,120,450 | A | * | 10/1978 | Whitehead | 494/20 |
| 4,531,652 | A | * | 7/1985 | Hara | 494/20 |
| 4,585,434 | A | * | 4/1986 | Cole | 494/20 |
| 4,589,864 | A | * | 5/1986 | Cole | 494/20 |
| 4,670,004 | A | * | 6/1987 | Sharples et al. | 494/20 |
| 4,718,885 | A | * | 1/1988 | Potter | 494/20 |
| 4,941,867 | A | * | 7/1990 | Tominaga | 494/16 |
| 5,470,758 | A | * | 11/1995 | Hayes | |
| 5,562,584 | A | * | 10/1996 | Romanauskas | 494/20 |
| 5,584,790 | A | * | 12/1996 | Bell et al. | 494/20 |
| 6,234,948 | B1 | * | 5/2001 | Yavilevich | 494/20 |
| 6,416,455 | B1 | * | 7/2002 | Aizawa et al. | 494/16 |

FOREIGN PATENT DOCUMENTS

| | | | |
|---|---|---|---|
| JP | 50-156989 | | 12/1975 |
| JP | 52-92968 | * | 8/1977 |
| JP | 53-131567 | * | 11/1978 |
| JP | 57-934 | | 1/1982 |
| JP | 9-155235 | | 6/1997 |
| JP | 9-155236 | | 6/1997 |
| JP | 2001-79451 | * | 3/2001 |

* cited by examiner

*Primary Examiner*—Charles E. Cooley
(74) *Attorney, Agent, or Firm*—McDermott Will & Emery LLP

(57) ABSTRACT

A rotor for a centrifugal separator. The rotor has a rotor body with a cylindrical outer wall extending upward from a bottom portion and a boss portion provided at a center of the bottom portion. The outer wall is located radially outward with respect to the boss portion serving as a rotational center of the rotor body. The rotor also has a plurality of buckets that are swingably supported in the rotor body and each of the buckets holds a boxlike sample container. A supporting element supports a hinge shaft serving as a swing center of the bucket. Each of the buckets has a bottom surface that is brought into contact with an inside surface of an outer wall of the rotor body due to a centrifugal force when the rotor rotates, so that the buckets and the rotor body integrally rotate during centrifugal operation. The hinge shaft is offset from a line extending from a centroid of the bucket perpendicularly to the bottom surface of the bucket, and is located at a position higher than the sample container and the bucket inclines obliquely with respect to the bottom portion of the rotor body when the rotor body is stopped.

2 Claims, 3 Drawing Sheets

CENTRIFUGAL ROTOR HAVING BUCKETS SWINGABLY SUPPORTED ON A HINGE SHAFT

BACKGROUND OF THE INVENTION

The present invention relates to a rotor of a centrifugal separator which is widely used in medical, pharmaceutical, and genetic engineering and other various fields.

Especially, the present invention relates to a rotor of a centrifugal separator which is preferably used to perform high-speed centrifugal operation of a microplate casing or a microtube assembly.

The microplate casing is a boxlike sample container whose size is approximately 130 mm in vertical width, approximately 90 mm in lateral width, and 10~50 mm in height. A plurality of sample storing recesses are formed on an upper surface of the microplate casing. The sample storing recesses are arranged in a predetermined matrix pattern consisting of a plurality of rows and lines. Each sample storing recess has a capacity and a depth sufficient for storing a liquid sample, such as blood components and culture solution, to be centrifuged for test or inspection.

The microtube assembly is similar to the microplate casing in size and configuration. The microtube assembly has an inside space for accommodating a plurality of plastic microtubes.

The microplate casing is generally made of plastic material such as polystyrene or polypropylene and is formed by molding. The microplate casing is disposable.

For example, the unexamined Japanese patent publication No. 50-156989, Japanese Utility Model No. 57-934, unexamined Japanese patent publication No. 9-155235, and unexamined Japanese patent publication No. 9-155236 disclose conventional rotors for the microplate casings.

FIG. 5 shows a representative conventional rotor. The conventional rotor shown in FIG. 5 chiefly consists of a rotor body 21, two buckets 23, and an adapter 24. The rotor body 21 is rotatable about a drive shaft 21 a when driven by a drive motor or any other actuator (not shown). The rotor body 21 has an H-shaped configuration with two cutout portions at the longitudinal ends thereof. In other words, each longitudinal end of the rotor body 21 is bifurcated so as to serve as arms for holding the bucket 23. Each bucket 23 is swingable about its shafts 23*a*. Both shafts 23*a* are supported by the bifurcated arms of rotor body 21. Two buckets 23 are positioned symmetrically with respect to the drive shaft 21*a*. When the rotor body 21 rotates for centrifugal operation, a centrifugal force acts on each bucket 23. The buckets 23 swing radially outward about their shafts 23*a* due to the centrifugal force. The buckets 23 face each other and are positioned in an opposed relationship during the centrifugal operation. The microplate casing is fixed in the bucket 23 via the adapter 24. Thus, the liquid sample stored in the microplate casing is subjected to the centrifugal force (i.e., a centrifugal acceleration). According to the arrangement of this conventional rotor, the maximum rotational speed reaches 2,000 to 6,000 rpm. The maximum centrifugal acceleration reaches 600 to 5,000Xg.

The recent representative application field of the centrifugal rotors is a genetic engineering. Highly advanced centrifugal rotors are the key for improving the efficiency of DNA and RNA related researches. In the process of DNA sequencing in this field, the centrifugal operation of DNA samples has an important role. Especially, in an ethanol sedimentary processing, an appropriate amount of ethanol is added to DNA containing solution and then the centrifugal operation is performed to collect or recover DNA. Conventionally, a plastic microtube (a sort of test tube) of 0.2 ml to 2 ml is used. The angle rotor or swing rotor, applicable to this plastic microtube, is rotated for the centrifugal operation at 12,000 rpm (equivalent to 10,000Xg) for 10 minutes. A microplate rotor is also used to perform the centrifugal operation at 6,000 rpm (equivalent to 5,000Xg) for 30 minutes.

According to the former centrifugal operation, an operator is required to handle each one of microtubes. This complicates the centrifugal operation and worsens the efficiency of centrifugal operation. The number of microtubes processible at the same centrifugal operation was limited to approximately 48 due to structural restrictions of the centrifugal separator.

According to the latter centrifugal operation, the microplate can process numerous samples at a time. However, the reachable centrifugal acceleration is dissatisfactory and the separation time is longer than 30 minutes. This worsens the efficiency of centrifugal operation.

The rotor disclosed in the unexamined Japanese patent publication No. 9-155236 obtains a high centrifugal force under the condition that the microplate casing is held in a perpendicular condition. However, after finishing the centrifugal operation, the separated sample is rotated from the upright position (90°) to the lying position (0°). This undesirably promotes remixing of the separated sample and the solution.

The centrifugal separators are widely used to perform health-related inspections, DNA and RNA related researches, tissue culture experiments or the like. The key for promptly accomplishing these inspections, researches, and experiments is to improve the efficiency of centrifugal operation required in an intermediate process of the inspection or the experiment, The efficiency of centrifugal operation can be improved by increasing the centrifugal acceleration given to the sample (i.e., by increasing the rotational speed of the centrifugal rotor). The efficiency of centrifugal operation can be also improved by increasing the number of simultaneously processible specimens.

The microplate casing has excellent capacity for processing as many as 96 specimens at a time. However, the conventional microplate swing rotors cannot increase the maximum rotational speeds due to their structural restrictions. Furthermore, the swing rotors have larger diameters. This inevitably induces the windage loss during the centrifugal operations. Thus, the swing rotors cannot increase the rotational speed as intended.

Moreover, according to the centrifugal rotor which holds the microplate in a perpendicular position during the centrifugal operation, the separated sample is turned 90° from the rotational condition to the stopped condition. Some samples will mix with the solution again. This is not appropriate.

A microplate rotor disclosed in the unexamined Japanese patent publication No. 50-156989 has an inclined arrangement in a stationary condition. However, according to this conventional microplate rotor, a rotational shaft must bear the centrifugal forces acting on both a basket and the microplate during rotation of the rotor. This kind of conventional microplate rotor cannot be used for high-speed centrifugal operation.

SUMMARY OF THE INVENTION

An object of the present invention is to realize high-speed centrifugal operation for a microplate casing or a microtuble assembly.

Another object of the present invention is to improve the efficiency of centrifugal operation.

Another object of the present invention is to prevent the separated samples from mixing with the solution again at the end of the centrifugal operation.

Anther object of the present invention is to provide a non-expensive centrifugal rotor.

In order to accomplish this and other related objects, the present invention provides a first rotor for a centrifugal separator comprising a rotor body having a cylindrical outer wall extending upward from a bottom portion and a boss portion provided at a center of the bottom portion. The outer wall is located radially outward with respect to the boss portion which serves as a rotational center of the rotor body. A plurality of buckets are swingably supported in the rotor body. Each bucket holds a boxlike sample container. And, a supporting means is provided for supporting a hinge shaft serving as a swing center of the bucket. According to the first rotor of this invention, each of the buckets has a bottom surface brought into contact with an inside surface of the outer wall due to a centrifugal force when the rotor rotates, so that the buckets and the rotor body integrally rotate during centrifugal operation.

Furthermore, the present invention provides a second rotor for a centrifugal separator comprising a rotor body having a cylindrical outer wall extending perpendicularly from a bottom portion and a boss portion provided at a center of the bottom portion. The outer wall is located radially outward with respect to the boss portion which serves as a rotational center of the rotor body. A plurality of buckets are swingably supported in the rotor body. Each bucket holds a boxlike sample container. A supporting means is provided for supporting a hinge shaft serving as a swing center of the bucket. Furthermore, a spring member is provided in the rotor body for resiliently supporting each bucket in an inclined condition with respect to a rotational axis of the rotor when the rotor is stopped. According to the second rotor of this invention, a bottom surface of the bucket is brought into contact with an inside surface of the outer wall against a resilient force of the spring member due to a centrifugal force when the rotor rotates, so that the buckets and the rotor body integrally rotate during centrifugal operation.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF PREFERRED EMBODIMENTS

Figure 1:
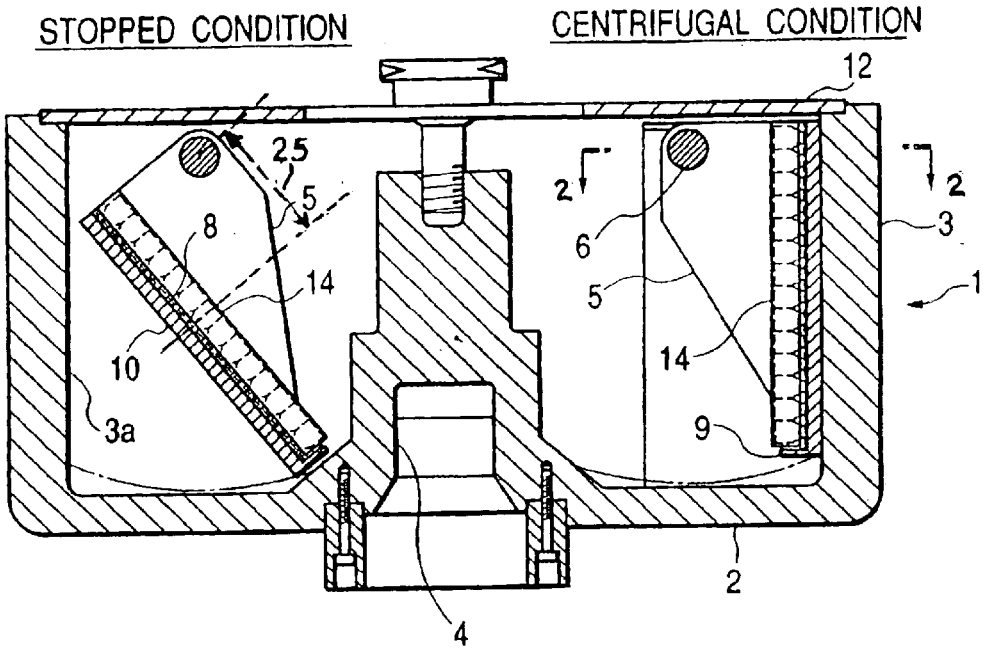
FIG. 1 is a vertical cross-sectional view showing a centrifugal rotor in accordance with a preferred embodiment of the present invention.

Preferred embodiments of the present invention will be explained with reference to attached drawings. Identical parts are denoted by the same reference numerals.

Figure 2:
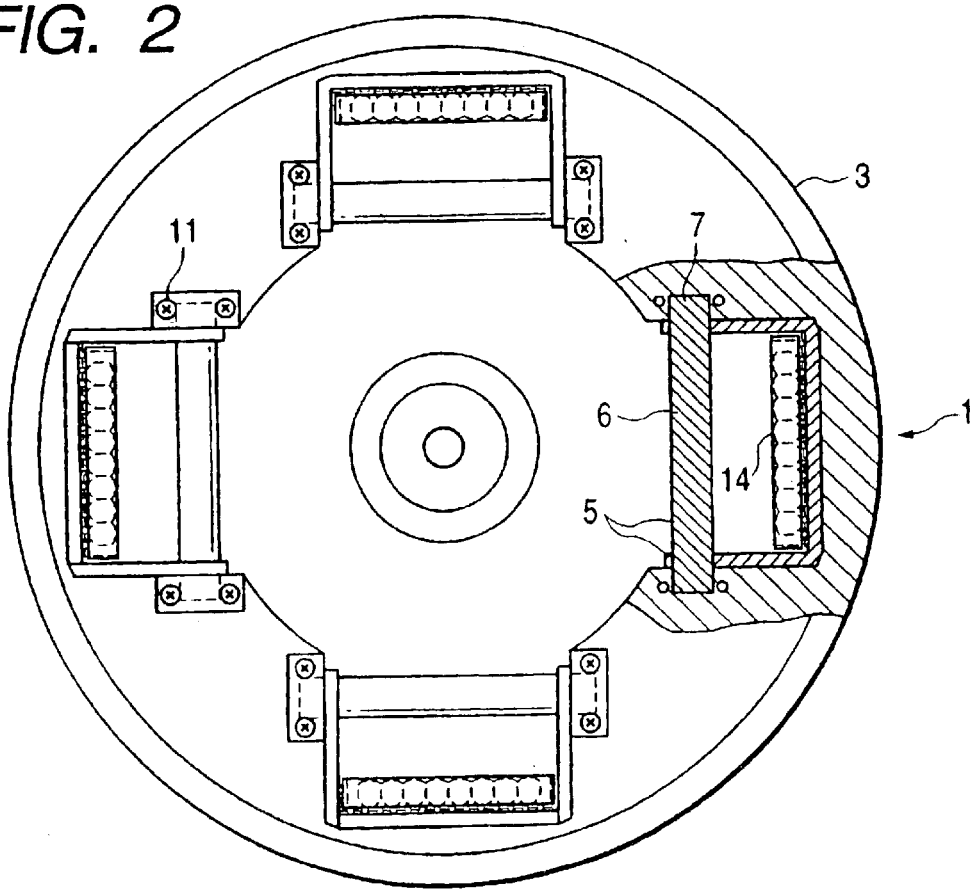
FIG. 2 is a plan view showing the centrifugal rotor shown in FIG. 1.

FIG. 1 is a vertical cross-sectional view of a centrifugal rotor in accordance with the present invention. The right half of FIG. 1 shows a centrifugal condition of this centrifugal rotor, while the left half of FIG. 1 shows a stopped condition of this centrifugal rotor. FIG. 2 is a plan view shown the centrifugal operation of the rotor shown in FIG. 1, although a cover plate 2 is removed. FIG. 2 partly shows a lateral cross-sectional view of the centrifugal rotor taken along a line 2—2 of FIG. 1.

The centrifugal rotor of this embodiment comprises a total of four buckets 5. A microplate casing 14, serving as a boxlike sample container, is placed in each bucket 5. The centrifugal rotor has a cylindrical rotor body 1. A central boss portion 4, provided at the center of a bottom portion 2 of rotary body 1, stands upright. The central boss portion 4 has an axial bore at its lower part. A drive shaft of a motor or an actuator (not shown) is fixedly inserted in the axial bore of the central boss portion 4. The cover plate 12 is supported at the top of central boss portion 4. The centrifugal rotor has a cylindrical wall 3 integrally formed with the bottom portion 2. The cylindrical wall 3 extends upward from the bottom portion 2.

Each bucket 5 has a hinge shaft 6 extending in a tangential direction with respect to the center axis (i.e., central boss portion 4) of the centrifugal rotor. The hinge shaft 6 is rotatably inserted in a bearing portion 7 formed on the rotor body 1. The bearing portion 7 is fixed by screws 11. Thus, the bucket 5 is swingable relative to the inner surface of the centrifugal rotor via the hinge shaft 6.

Each bucket 5 has a receiving surface 8 which mounts or holds the microplate casing 14. A stopper 9 is formed at the lower end of the receiving surface 8. The stopper 9 supports the lower end of the microplate casing 14 when the microplate casing 14 is placed on the receiving surface 8.

The bucket 5 has a bottom surface 10. When the bucket 5 swings radially outward about the hinge shaft 6 during centrifugal operation, the bottom surface 10 of bucket 5 is just brought into contact with an inside surface 3*a* of the wall 3. In other words, the bottom surface 10 of bucket 5 is kept perpendicular to the bottom portion 2 of rotor body 1 When the rotor is stopped, the bucket 5 hangs down from the hinge shaft 6 due to its own weight. In a stopped condition, the centroid of bucket 5 mounting the microplate casing 14 is positioned right under the hinge shaft and the bottom surface 10 of bucket 5 inclines obliquely with respect to the bottom portion of rotor body 1. For example, the inclined angle of the bottom surface 10 of bucket 5 with respect to the bottom portion 2 of rotor body 1 is in a range from 0° to 90°. According to the embodiment shown in FIG. 1, the inclined angle is approximately 60°. Supporting the microplate casing 14 obliquely is advantageous in that a sufficient amount of the liquid sample can be kept in the sample storing recess of the microplate casing 14. As further shown in FIG. 1, hinge shaft 6 is positioned at offset 25 from a line extending from the centroid of the bucket 5 perpendicularly to the bottom surface 10 of the bucket 5. In addition, hinge shaft 6 is located at a position higher, in a direction perpendicular to the bottom surface 10 of the bucket 5, than the microplate casing 14, serving as a boxlike sample container.

During the centrifugal operation, the liquid surface stands upright due to a centrifugal force. Sample particles or grains sediment and adhere to the bottom of the sample storing recess. The adhered sample particles or grains do not easily peel off the bottom of the sample storing recess. After the centrifugal operation is finished, the bucket 5 returns to the free position shown in the left half of FIG. 1. The sediment of the sample and the liquid can be surely recovered.

Figure 3:
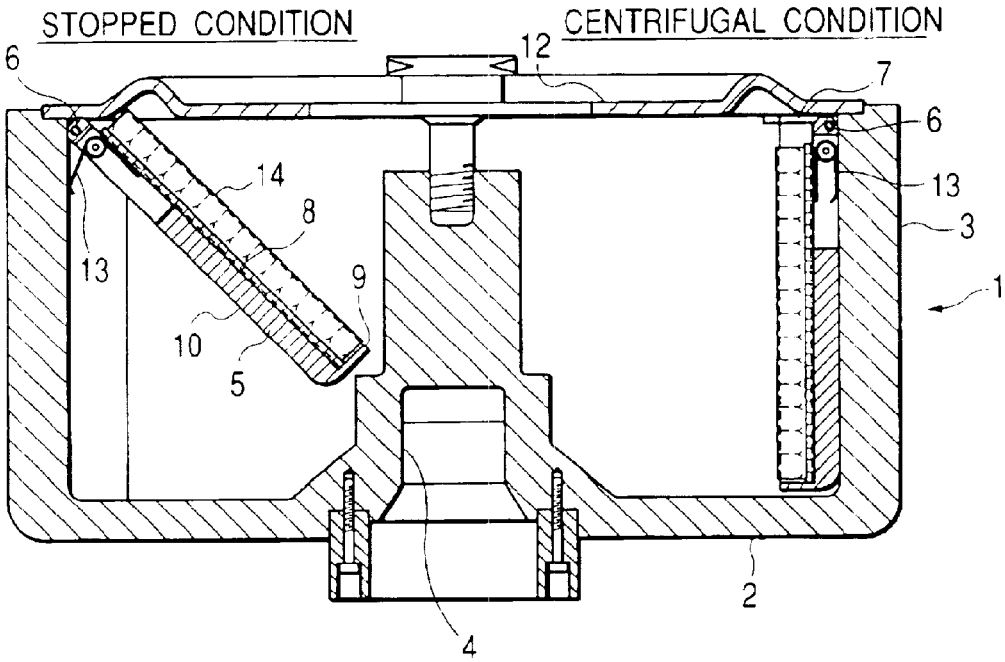
FIG. 3 is a vertical cross-sectional view showing another centrifugal rotor in accordance with a preferred embodiment of the present invention.
Figure 4:
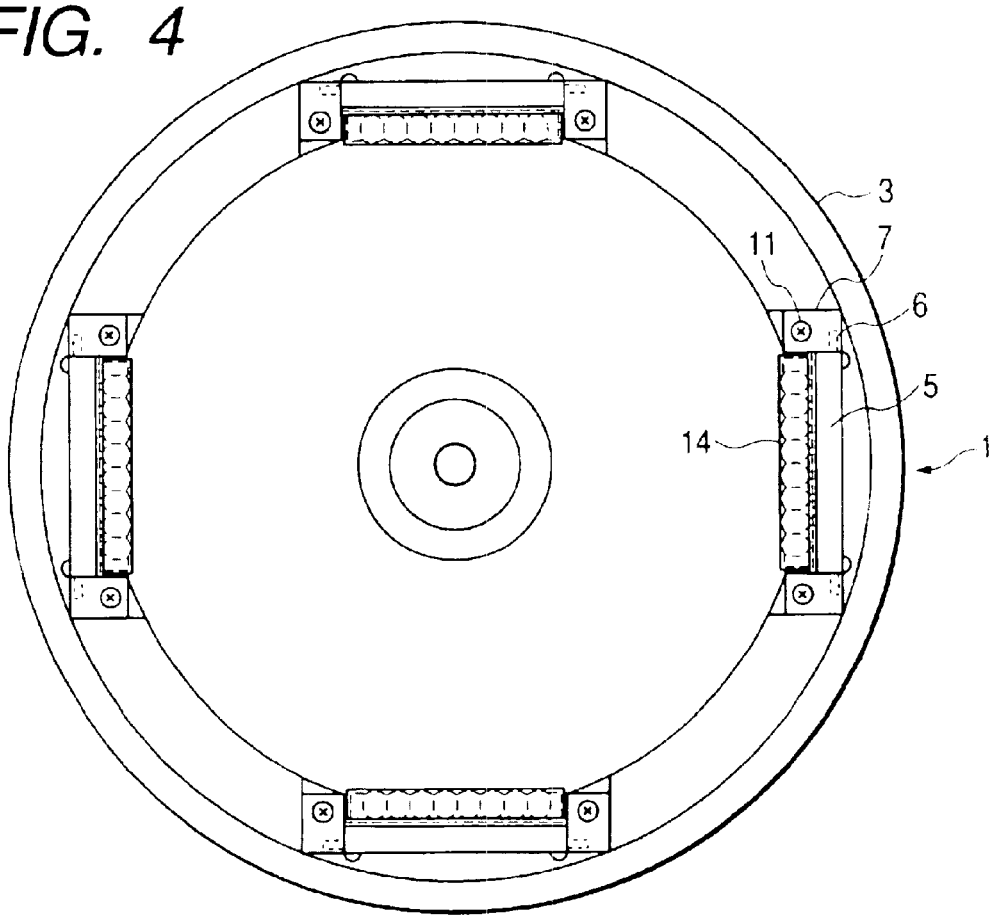
FIG. 4 is a plan view showing the centrifugal rotor shown in FIG. 3.
Figure 5:
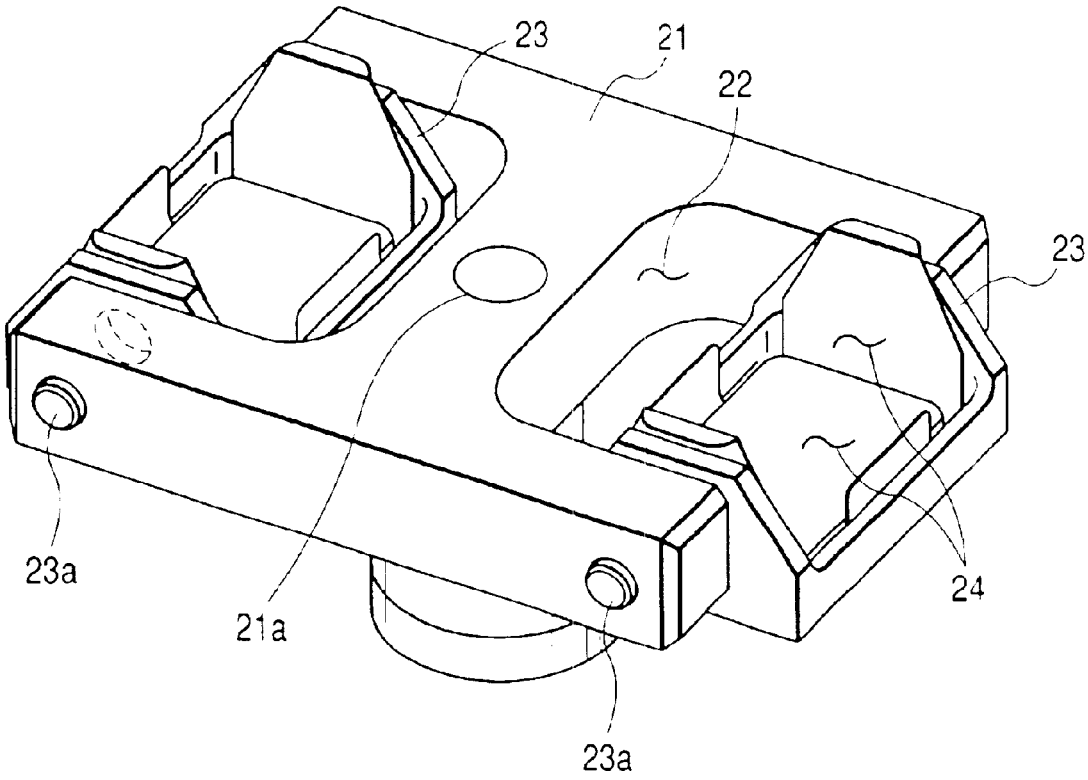
FIG. 5 PRIOR ART
FIG. 5 is a perspective view showing a conventional centrifugal rotor.

FIG. 3 is a vertical cross-sectional view of another centrifugal rotor in accordance with the present invention. The right half of FIG. 3 shows a centrifugal condition of this centrifugal rotor, while the left half of FIG. 3 shows a stopped condition of this centrifugal rotor. FIG. 4 is a plan view showing the centrifugal operation of the rotor shown in FIG. 3, although the cover plate 12 is removed.

According to the embodiment shown in FIGS. 3 and 4, a spring member 13 is attached to the bottom surface 10 of bucket 5. The spring member 13 is positioned between the bottom surface 10 of bucket 5 and the inside surface 3*a* of the wall 3. The hinge shaft 6 is positioned at the uppermost end of the bucket 5. The spring member 13 is located adjacent to the hinge shaft 6. The spring 13 holds the bucket 5 obliquely when the rotor is stopped. During centrifugal operation, the bucket 5 swings radially outward about the hinge shaft 6 due to a centrifugal force against a resilient force of spring 13. The bottom surface 10 of bucket 5 is brought into contact with the inside surface 3*a* of the wall 3. The bottom surface 10 of bucket 5 is kept perpendicular to the bottom portion 2 of rotor body 1. When the rotor is stopped, the bucket 5 is resiliently pushed radially inward by the spring 13. The bottom surface 10 of bucket 5 is kept obliquely with respect to the bottom portion 2 of rotor body 1. Like the above-described embodiment, the inclined angle of the bottom surface 10 of bucket 5 with respect to the bottom portion 2 of rotor body 1 is greater than 0° and less than 90°. According to the embodiment shown in FIG. 3, the inclined angle is approximately 45°. As already explained, supporting the microplate casing 14 obliquely is advantageous in that a sufficient amount of liquid sample can be kept in the sample storing recess of the microplate casing 14.

In FIGS. 1 to 4, the rotor body 1 and the bucket 5 are made of metallic material such as an aluminum alloy or a titanium alloy. However, a plastic material or a composite material can be also used if these materials are strong enough. Fastening screws are made of metallic material having sufficient strength. When the rotor rotates for centrifugal operation, the rotor body 1 must securely hold the buckets 5 and the microplate casings 14 mounted thereon. In other words, a large centrifugal force acts on the wall 3 of the rotor body 1. The rotor body 1 is required to have sufficient strength or rigidity durable against high-speed centrifugal operation.

To check the strength of a rotor having the above-described arrangement of the present invention, the inventor of this invention has manufactured a proto-type rotor having the maximum diameter of 300 mm with the rotor body and the buckets made of aluminum alloy. The proto-type rotor has demonstrated satisfactory durability for 10,000 rpm and 13,000Xg. If the used aluminum alloy or titanium alloy has further higher strength, it will be possible to assure the durability for centrifugal operation in a further higher speed range.

Furthermore, it is possible to provide many (e.g., four to six) sample inserting portions. It is possible to realize efficient centrifugal operation by increasing the rotor speed and increasing the processible sample numbers.

The cover plate 12 suppresses the windage loss caused by rotation of the rotor. Thus, the cover plate 12 enables the rotor to operate at higher speeds and reduces the rotary noise.

The manufacturing cost for the rotor of this invention is chiefly classified into a material cost and a processing (or machining) cost. The material cost is relatively fixed, because it is substantially determined depending on the size of rotor as well as the size of microplate casings. Thus, the manufacturing cost for the rotor is variable depending on the processing (or machining) cost. For example, according to the rotor shown in FIG. 1, the rotor body 1 is processed or machined by simple operations such as turning and milling operations. The buckets 5 do no require so large strength as they are held by the rotor body 1 during the high-speed centrifugal operation. The buckets 5 can be made of plastic molded member or extruded aluminum product. The manufacturing costs can be reduced. Regarding the actual centrifugal separation effects, due to the excellent durability exceeding 10,000Xg, the centrifugal rotor of this invention will bring sufficient separation result for DNA ethanol sedimentary processing through only 10 minutes centrifugal operation.

As described above, the present invention provides a centrifugal rotor capable of promptly accomplishing high-speed centrifugal operations for a microplate casing and a microtube assembly storing numerous liquid samples. The present invention provides a centrifugal rotor which is non-expensive in manufacturing costs.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A rotor for a centrifugal separator comprising:

a rotor body having a cylindrical outer wall extending upward from a bottom portion and a boss portion provided at a center of said bottom portion, said outer wall being located radially outward with respect to said boss portion serving as a rotational center of said rotor body;

a plurality of buckets swingably supported in said rotor body, each bucket holding a boxlike sample container; and a supporting means for supporting a hinge shaft serving as a swing center of said bucket, wherein each of said buckets has a bottom surface brought into contact with an inside surface of said outer wall due to a centrifugal force when said rotor rotates, so that said buckets and said rotor body integrally rotate during centrifugal operation, and said hinge shaft is offset from a line extending from a centroid of said bucket perpendicularly to said bottom surface of said bucket, and is located at a position higher than said sample container and said bucket inclines obliquely with respect to the bottom portion of said rotor body in a condition that said rotor body is stopped.

2. A rotor for a centrifugal separator comprising:

a rotor body having a cylindrical outer wall extending perpendicularly from a bottom portion and a boss portion provided at a center of said bottom portion, said outer wall being located radially outward with respect to said boss portion serving as a rotational center of said rotor body;

a plurality of buckets swingably supported in said rotor body, each bucket holding a boxlike sample container;

a supporting means for supporting a hinge shaft serving as a swing center of said bucket; and a spring member provided in said rotor body for resiliently supporting each bucket so that each bucket inclines obliquely with respect to the bottom portion of said rotor body in a condition that said rotor is stopped, wherein a bottom surface of said bucket is brought into contact with an inside surface of said outer wall against a resilient force of said spring member due to a centrifugal force when said rotor rotates, so that said buckets and said rotor body integrally rotate during centrifugal operation.

* * * * *